US008136215B2

(12) United States Patent
Schulze

(10) Patent No.: US 8,136,215 B2
(45) Date of Patent: Mar. 20, 2012

(54) UNCOILING DEVICE

(75) Inventor: Bertram Schulze, Hausen (DE)

(73) Assignee: Siemens Aktiengesellschaft, Munich (DE)

( * ) Notice: Subject to any disclaimer, the term of this patent is extended or adjusted under 35 U.S.C. 154(b) by 482 days.

(21) Appl. No.: 12/308,605

(22) PCT Filed: Jun. 4, 2007

(86) PCT No.: PCT/EP2007/055475
§ 371 (c)(1),
(2), (4) Date: Dec. 18, 2008

(87) PCT Pub. No.: WO2007/147721

PCT Pub. Date: Dec. 27, 2007

(65) Prior Publication Data

US 2009/0307889 A1 Dec. 17, 2009

(30) Foreign Application Priority Data

Jun. 19, 2006 (DE) ..... 10 2006 028 102

(51) Int. Cl.
*B23P 23/00* (2006.01)
*B21B 39/02* (2006.01)
*B21D 1/02* (2006.01)

(52) U.S. Cl. ..... 29/33 B; 29/33 Q; 29/33 S; 29/564.8; 72/9.2; 72/11.8; 72/160; 228/9; 228/5.7; 228/170; 700/150; 700/154

(58) Field of Classification Search ..... 29/33 B, 29/33 Q, 33 S, 564, 564.1, 564.6, 564.8; 72/9.2, 11.8, 160; 700/150–155; 228/102–103, 228/164, 170–171, 5.7, 8, 9
See application file for complete search history.

(56) References Cited

U.S. PATENT DOCUMENTS 3,342,047 A * 9/1967 Briggs ..... 72/8.4
2008/0098784 A1 * 5/2008 Hartung et al. ..... 72/160

FOREIGN PATENT DOCUMENTS

| | | | |
|---|---|---|---|
| DE | 1752406 | A1 | 9/1971 |
| DE | 2117489 | A1 | 10/1971 |
| DE | 19503850 | C1 | 6/1996 |
| DE | 10115047 | A1 | 10/2002 |
| DE | 102004041732 | A1 | 3/2006 |
| EP | 009581 | A1 * | 4/1980 |
| EP | 0459869 | A1 | 12/1991 |
| EP | 0659518 | A1 | 6/1995 |
| EP | 1413371 | A2 | 4/2004 |
| RU | 2196836 | C2 | 1/2003 |
| SU | 1297963 | A1 | 3/1987 |
| SU | 1378977 | A1 | 3/1988 |

OTHER PUBLICATIONS

Machine Translation of EP 659518, which EP '518 was published Jun. 1995.*

(Continued)

*Primary Examiner* — Erica E Cadugan

(57) ABSTRACT

An uncoiling device having an uncoiler for uncoiling a strip is described. The uncoiler is arranged downstream from a thickness measuring device which measures the thickness of the strip. The thickness measuring device is arranged downstream from a straightening device which straightens the strip. The straightening device is arranged downstream from a machining device which further machines the strip. The thickness of the strip is transmitted to a control device which controls the straightening machine and/or the machining device in accordance with the measured thickness of the strip.

16 Claims, 2 Drawing Sheets

OTHER PUBLICATIONS

Machine Translation of EP 009581, which EP '581 was published Apr. 1980.*

Communication from Russian Patient Office citing documents, received Oct. 17, 2011, pp. 6.

* cited by examiner

UNCOILING DEVICE

CROSS REFERENCE TO RELATED APPLICATIONS

This application is the US National Stage of International Application No. PCT/EP2007/055475 filed Jun. 4, 2007, and claims the benefit thereof. The International Application claims the benefits of German application No. 10 2006 028 102.0 DE filed Jun. 19, 2006. Both of the applications are incorporated by reference herein in their entirety.

FIELD OF INVENTION

The present invention relates to an uncoiling device that contains the following elements:

an uncoiler for uncoiling a strip;

a leveling machine disposed downstream of the uncoiler and provided for leveling the uncoiled strip;

a height measuring device disposed downstream of the leveling machine and provided for registering the height position of the leveled strip;

a machining device disposed downstream of the height measuring device and provided for further machining the leveled strip;

a control device to which the uncoiled strip's thickness measured by the thickness measuring device and the registered height position can be conveyed and by which control values for the leveling machine can be determined on the basis of a determining rule as a function of the measured thickness of the uncoiled strip and at least the leveling machine can be controlled.

BACKGROUND OF INVENTION

A device of said type is known from DE 10 2004 041 732 A1. It is used, for instance, when a plurality of strips are to be welded together.

SUMMARY OF INVENTION

For setting the correct height position of the leading end and trailing end of the strip the leveling machine must have been correctly controlled.

An object of the present invention is to provide an uncoiling device that can be operated in a more optimized manner.

The object is achieved with an uncoiling device including an uncoiler, a thickness measuring device, a leveling machine, a height measuring device, a machining device, and a control device which receives a thickness of the strip measured by the thickness measuring device and a height position registered by the height measuring device. The control device controls the leveling machine and determines control values for the leveling machine based upon a determining rule as a function of the thickness of the strip, wherein the control device adapts the determining rule as a function of the height position.

The determining rule can be adapted by the control device as a function of the registered height position.

The thickness measuring device is embodied preferably as a distance-based thickness measuring device. Examples of thickness measuring devices of said type are measuring devices that operate on an eddy-current basis and measuring devices based on propagation time. The latter operate on the basis of ultrasound or light, in particular by means of lasers. Distance-based thickness measuring devices are preferred particularly because they are compact, economical and reliable. In particular, already existing uncoiling devices can even be retrofitted with thickness measuring devices of said type.

It is possible for the thickness measuring device to scan one side of the uncoiled strip. In that case it must be ensured that the non-scanned side of the strip is at a defined level. For example, it is possible for the uncoiled strip to run over a reference roller at the point at which it is scanned by the thickness measuring device.

Alternatively it is possible for the thickness measuring device to scan two sides of the uncoiled strip. Although such an embodiment of the thickness measuring device necessitates a greater overhead in terms of equipment, that is offset by its being possible to register the thickness of the strip independently of its height position.

It is possible for the uncoiler to be additionally controllable by the control device.

BRIEF DESCRIPTION OF THE DRAWINGS

Further advantages and specifics will emerge from the following description of exemplary embodiments in conjunction with the drawings, which are basic representations.

DETAILED DESCRIPTION OF INVENTION

Figure 1:
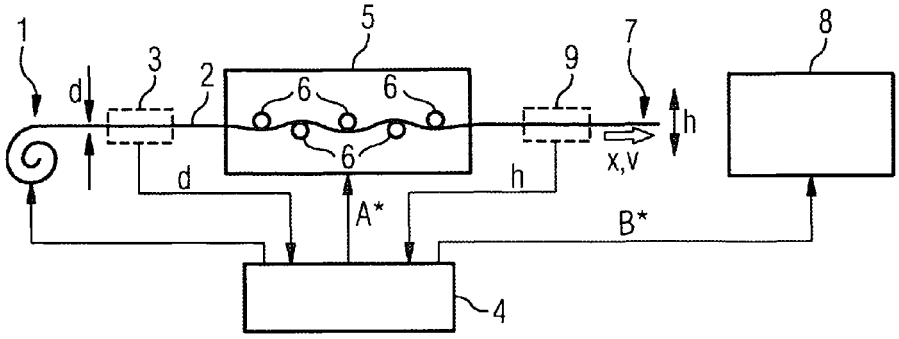
FIG. 1 shows an uncoiling device.

According to FIG. 1, an uncoiling device includes an uncoiler 1. A strip 2 can be uncoiled by means of the uncoiler 1. The strip 2 is typically a thin metal strip, for example a steel strip. It generally has a strip thickness d of 0.1 to 8.0 mm.

Disposed downstream of the uncoiler 1 is a thickness measuring device 3. The thickness d of the strip 2 can be dynamically measured by means of the thickness measuring device 3. The measured strip thickness d is conveyed to a control device 4 by the thickness measuring device 3.

Disposed downstream of the thickness measuring device 3 is a leveling machine 5. The leveling machine 5 has a plurality of rollers 6. The rollers 6 are arranged mutually displaced in a strip running direction x. They can be applied against the strip 2 in an alternating manner from above and/or from below.

The strip 2 can be leveled by means of the rollers 6 of the leveling machine 5, meaning that a horizontal height position h can be set at which a leading end 7 of the strip 2 and a trailing end of the strip 2 enter a machining device 8. The machining device 8 is disposed downstream of the leveling machine 5. The strip 2 is further machined by it.

Disposed between the leveling machine 5 and the machining device 8 is a height measuring device 9. The height position h of the strip 2 is registered by it and conveyed to the control device 4.

The control device 4 typically controls the entire uncoiling device, which is to say the uncoiler 1, the leveling machine 5 and the machining device 8. This case will be explained below in conjunction with FIG. 2. It would, however, basically suffice for the control device 4 to control the leveling machine 5—in particular the leveling machine 5 and the machining device 8.

Figure 2:
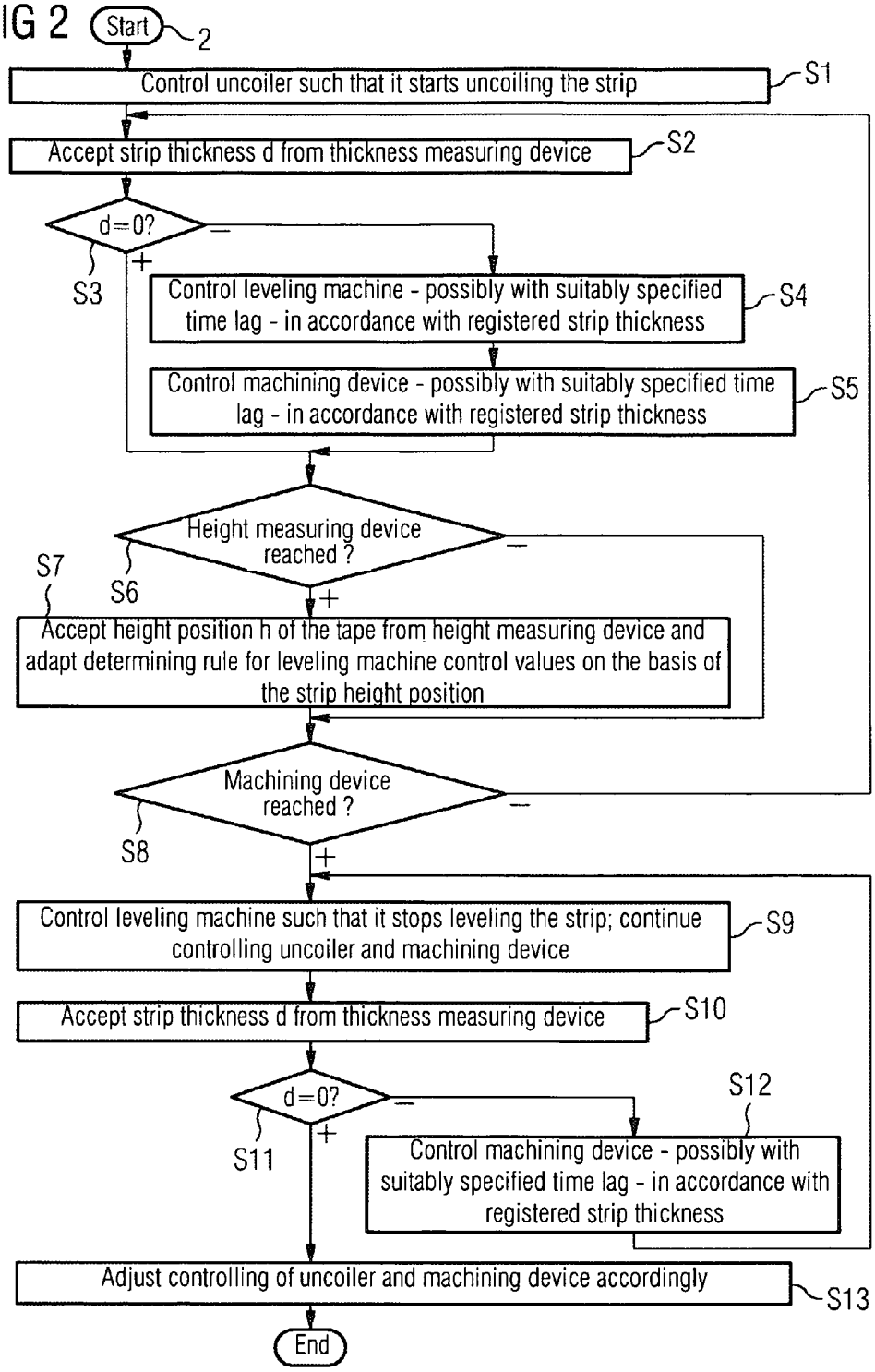
FIG. 2 is a flowchart.

According to FIG. 2, the control device 4 initially controls the uncoiler 1 at a step S1 in such a way that the uncoiler 1 starts uncoiling the strip 2.

At a step S2 the control device 4 accepts the strip thickness d registered by the thickness measuring device 3.

At a step S3 the control device 4 checks whether the strip thickness d conveyed to it is different from zero, meaning whether the strip 2 is being registered by the thickness measuring device 3. If that is the case, the control device 4 will at a step S4—possibly with a suitable time lag—control the leveling machine 5 as a function of the registered thickness d. Within the scope of step S4 the control device 4 can in particular determine on the basis of a determining rule control values A* for the individual rollers 6 of the leveling machine 5 as a function of the measured thickness d of the uncoiled strip 2 and convey the determined control values A* to the leveling machine 5.

At a step S5 the control device 4 can—possibly with a suitably specified time lag—determine control values B* for the machining device 8 and convey them to the machining device 8. The control values B* for the machining device 8 can likewise depend on the measured thickness d of the uncoiled strip 2. For example, a point in time can be determined as of which the actual strip thickness d deviates from a setpoint thickness d* by no more (or less) than a permissible thickness tolerance δd. In this case the machining device 8 can be controlled in such a way, for example, that the leading end 7 of the strip will be separated from the rest of the strip 2 at the corresponding point on the strip 2. A distance which cutters of a corresponding separating device have in the strip running direction x can additionally be set as a function of the measured thickness d of the uncoiled strip 2.

At a step S6 the control device 4 checks whether the strip 2 has yet reached the height measuring device 9. This can be determined by means of, for example, a simple tracking method generally familiar to persons skilled in the relevant art.

At a step S7 the control device 4 accepts the height position h, registered by the height measuring device 9, of the leveled strip 2 and as a function of the registered height position h adapts the determining rule on the basis of which it determines the control values A* for the leveling machine 5. In particular the control device 4 can compare the registered height position h with a setpoint height position h* and adapt the determining rule on the basis of the comparison.

Adapting determining rules is as such generally familiar to persons skilled in the relevant art. For example, adaptive rules and model-based determining methods operate on these principles.

At a step S8 the control device 4 checks whether the strip 2 has reached the machining device 8. This check, too, can be performed by means of, for example, a tracking method. Alternatively it is possible for a corresponding feedback message to be conveyed to the control device 4 by the machining device 8.

If the strip 2 has not yet reached the machining device 8, the control device 4 returns to step S2. If the strip 2 has already reached the machining device 8, the control device 4 resumes executing the method at a step S9.

At step S9 the control device 4 controls the leveling machine 5 in such a way that the latter stops leveling the strip 2. In particular the rollers 6 are disengaged from the strip 2. Controlling of the uncoiler 1 and machining device 8 will, by contrast, be retained within the scope of step S9. For example, a strip speed v at which the strip 2 is uncoiled can be increased within the scope of step S9 depending on further machining.

At a step S10 the control device 4 again accepts the thickness d of the strip 2 from the thickness measuring device 3.

At a step S11 the control device 4 checks whether the registered strip thickness d has the value zero.

If the strip thickness d does not have the value zero, at a step S12 the control device 4 will—possibly again with a suitably specified time lag—control the machining device 8 in accordance with the registered thickness d of the strip 2. For example, it is possible to register—analogously to the procedure for the leading end 7 of the strip—as of what point in time the strip thickness d deviates from the setpoint thickness d* by more than the permissible thickness tolerance 6*d*. In this case the machining device 8 can be controlled in such a way as to separate a trailing end of the strip, not identified further in the FIGs, from the rest of the strip 2. The control device 4 thereupon returns to step S9.

The trailing end of the strip will have passed by the thickness measuring device 3 if the registered thickness d of the strip 2 has reached the value zero. In this case the control device 4 will, at a step S13, adjust controlling of the uncoiler 1 and machining device 8 accordingly. For example, the strip speed v can be reduced. The leveling machine 5 can also be controlled again.

The thickness measuring device 3 can be embodied basically in any manner. For example, it can operate with radiation that penetrates the strip 2. Examples of radiation of said type are x-radiation and gamma radiation. Preferably, however, the thickness measuring device is embodied as a distance-based thickness measuring device 3, particularly one based on propagation time. Thickness measuring devices 3 of said type operate, not with penetrating radiation, but, for example, with radiation that is reflected from the strip 2. Examples of suitable types of radiation are sound (in particular ultrasound) and light, particularly laser light. The wavelength of light used can possibly be in the visible, infrared or even ultraviolet range.

Figure 3:
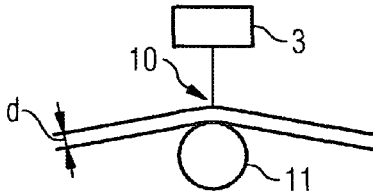
FIGS. 3-5 show possible embodiments of thickness measuring devices.
Figure 4:
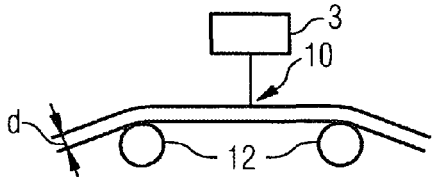
Figure 5:
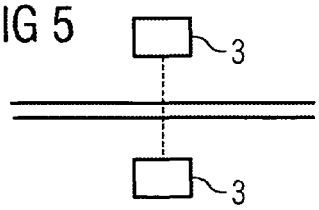

FIGS. 3 to 5 show examples of thickness measuring devices 3 based on propagation time.

According to FIG. 3, the thickness measuring device 3 scans one side of the uncoiled strip 2 at a scanning point 10. The term "scanning point" relates in this context not to the side of the strip 2 that is scanned but to the position in the strip running direction x at which the strip 2 is scanned.

According to FIG. 3, the uncoiled strip 2 runs over a reference roller 11 at the scanning point 10. According to FIG. 4, the scanning point 10 is located between two guide rollers 12.

According to FIG. 5, the thickness measuring device 3 scans two sides of the uncoiled strip 2. In this case there can be no reference roller at the scanning point 10.

The height measuring device 9 can—provided it is present—be embodied similarly to the thickness measuring device 3. Scanning on one side without a reference roller will generally suffice for the height measuring device 9.

Figure 6:
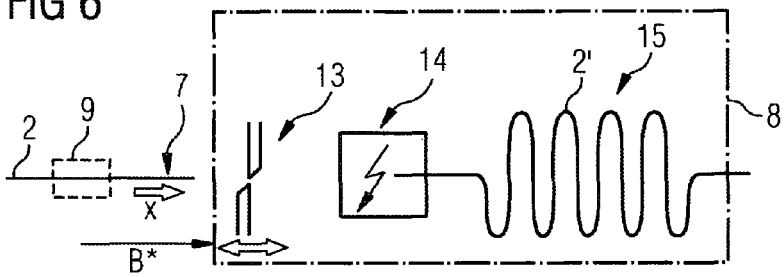
FIG. 6 shows a possible embodiment of a machining device.

FIG. 6 shows a typical embodiment of the machining device 8. According to FIG. 6, the machining device 8 has a plurality of partial devices 13 to 15. According to FIG. 6, the partial device 13 nearest the leveling machine 5 is embodied in the form of shears 13. In particular the leading end 7 of the strip and the trailing end of the strip can be separated from the rest of the strip 2 by means of the shears 13. The shears 13 can preferably move in the strip running direction x (being what are termed flying shears). This is indicated in FIG. 6 by a double arrow next to the shears 13.

According to FIG. 6, the partial device 14 disposed downstream of the shears 13 is embodied as a welding device 14. The leveled strip 2 can be welded to another strip 2' by means of the welding device 14.

According to FIG. 6, the partial device 15 disposed downstream of the welding device 14 is embodied as a strip store 15. It could alternatively be embodied as a cleaning device.

The other strip 2' can be intermediately stored by means of the strip store 15. The strip store 15 is typically embodied as what is termed a looping pit.

Optimized operation of the leveling machine 5 is possible by the uncoiling device. The thickness measuring device 3 is economical, compact and reliable. The strip 2 can be transported more quickly than in the case of the prior art. The strip store 15 can furthermore be dimensioned smaller than in the case of the prior art.

The above description serves exclusively to explain the present invention. By contrast, the scope of protection of the present invention is to be determined exclusively by the attached claims.

The invention claimed is:

1. An uncoiling device, comprising:

an uncoiler for uncoiling a strip;

a thickness measuring device disposed downstream of the uncoiler for measuring a thickness of the strip;

a leveling machine disposed downstream of the thickness measuring device for leveling the strip;

a height measuring device disposed downstream of the leveling machine for registering a height position of the strip;

a machining device disposed downstream of the height measuring device for machining the strip; and a control device which receives the thickness of the strip measured by the thickness measuring device and the height position registered by the height measuring device, wherein the control device determines control values for the leveling machine based upon a determining rule as a function of the thickness of the strip, wherein the control device controls the leveling machine, and wherein the control device adapts the determining rule as a function of the height position.

2. The uncoiling device as claimed in claim 1, wherein the thickness measuring device is a distance-based thickness measuring device.

3. The uncoiling device as claimed in claim 2, wherein the thickness measuring device scans one side of the strip.

4. The uncoiling device as claimed in claim 3, wherein the strip runs over a reference roller at a point at which the strip is scanned by the thickness measuring device.

5. The uncoiling device as claimed in claim 4, wherein the uncoiler is controlled by the control device.

6. The uncoiling device as claimed in claim 3, wherein the uncoiler is additionally controlled by the control device.

7. The uncoiling device as claimed in claim 2, wherein the thickness measuring device scans two sides of the strip.

8. The uncoiling device as claimed in claim 7, wherein the uncoiler is controlled by the controlled device.

9. The uncoiling device as claimed in claim 2, wherein the uncoiler is controlled by the control device.

10. The uncoiling device as claimed in claim 1, wherein the uncoiler is controlled by the control device.

11. The uncoiling device as claimed in claim 10, wherein the machining device has a plurality of devices, wherein a first device of the plurality of devices, which is located next to the leveling machine, is embodied in form of shears.

12. The uncoiling device as claimed in claim 11, wherein a second device of the plurality of devices, which is located downstream of the shears, is a welding device for welding the leveled-strip to another strip.

13. The uncoiling device as claimed in claim 12, wherein a third device of the plurality of devices, which is located downstream of the welding device, is embodied as a strip store for buffering the other strip.

14. The uncoiling device as claimed in claim 1, wherein the machining device has a plurality of devices, wherein a first device of the plurality of devices, which is located next to the leveling machine, is embodied in form of shears.

15. The uncoiling device as claimed in claim 14, wherein a second device of the plurality of devices, which is located downstream of the shears, is a welding device for welding the strip to another strip.

16. The uncoiling device as claimed in claim 15, wherein a third device of the plurality of devices, which is located downstream of the welding device, is embodied as a strip store for buffering the other strip.

* * * * *